US006293823B1

(12) United States Patent
Kasuga

(10) Patent No.: US 6,293,823 B1
(45) Date of Patent: Sep. 25, 2001

(54) NUT-PREFIXED CONNECTOR

(75) Inventor: Akira Kasuga, Tokyo (JP)

(73) Assignee: Kel Corporation, Tokyo (JP)

( * ) Notice: Subject to any disclaimer, the term of this patent is extended or adjusted under 35 U.S.C. 154(b) by 0 days.

(21) Appl. No.: 09/677,025

(22) Filed: Sep. 29, 2000

(30) Foreign Application Priority Data

Oct. 1, 1999 (JP) ..... 11-281363

(51) Int. Cl.[7] ..... H01R 13/73
(52) U.S. Cl. ..... 439/573
(58) Field of Search ..... 439/573, 564

(56) References Cited

U.S. PATENT DOCUMENTS 5,249,983 * 10/1993 Hirai ..... 439/573
5,971,802 * 10/1999 Pan et al. ..... 439/573
6,027,372 * 2/2000 Lai et al. ..... 439/573
6,102,735 * 8/2000 Chen et al. ..... 439/573

* cited by examiner

*Primary Examiner*—Gary Paumen
(74) *Attorney, Agent, or Firm*—Robert W. J. Usher

(57) ABSTRACT

A nut-fixing part 20 formed in a housing 10 has a nut-holding room 26, where a nut 30 is insertable and detachable by a movement in a direction perpendicular to the thickness direction of the nut 30. At the entrance of the nut-holding room 26, a projection 27 is provided to prevent the inserted nut 30 from sliding out. By this construction, this type of connector can be miniaturized further. In addition, when this connector mounted on a circuit board is heated in a furnace for soldering electrical connections, even if the housing experiences a stress relief, there is no possibility of any nut falling off from the housing.

10 Claims, 4 Drawing Sheets

NUT-PREFIXED CONNECTOR

RELATED APPLICATIONS

This application claims the priority of Japanese Patent Application No.11-281363 filed on Oct. 1, 1999 filed which is incorporated here in by reference.

FIELD OF THE INVENTION

The present invention relates to a nut-prefixed connector whose housing has pre-installed nuts, to which bolts are applied to fix the connector on a circuit board in a later assembly process.

BACKGROUND OF THE INVENTION

There is a conventional electrical connector whose housing incorporates a plurality of contacts and which is to be fixed tightly on a circuit board with bolts and nuts. For such a connector, it is a customary design practice that nuts are press-fit into and fixed at predetermined positions of the housing during the assembly of the connector before the connector is actually installed on a circuit board. This type of connector simplifies the process of assembling the connector on a circuit board. Because the nuts are already provided at predetermined positions of the connector, the connector placed on a circuit board can be fixed simply by putting bolts through pre-arranged through-holes of the circuit board.

Because this connector needs a strength to withstand the press-fitting of the nuts at the predetermined positions of the housing, the housing must be designed to have a sufficient thickness. As a result, the external dimensions of the housing are relatively large, so it is difficult to miniaturize the connector. Furthermore, in an assembly process where this type of connector is mounted on a circuit board, the contacts of the connector are placed directly on solder-coated connection terminals of electrical pathways of a circuit, which is printed on the circuit board, and then the connector and the circuit board in this condition are heated together in a furnace to fuse the solder and thereby to connect the contacts of the connector to the corresponding pathways of the circuit on the circuit board ( surface-mounting process ). If the above mentioned connector with nuts press-fit in the housing is heated in a furnace, then the resin forming the housing is somewhat relieved of the stress that resulted from the press-fitting of the nuts, so, accordingly, the force holding the nuts in the housing of the connector is reduced. This condition may result in one or all of the nuts to fall off from the housing.

SUMMARY OF THE INVENTION

It is an object of the present invention to miniaturize a nut-prefixed connector.

It is another object of the present invention to provide a nut-prefixed connector whose nuts will not fall off even if the connector is heated in a furnace when it is installed (surface-mounted) on a circuit board.

In order to achieve these objectives, the present invention provides a nut-prefixed connector with a nut-fixing part which is provided in a housing. This nut-fixing part includes a nut-holding room, and a nut is insertable into and detachable from the nut-holding room by a movement in a direction perpendicular to the thickness direction of the nut. In addition, a projection is provided at the entrance of the nut-holding room to prevent the nut inserted in the nut-holding room from coming out.

In a prior-art connector of this type, the nut inserted in the nut-holding room is retained therein by the pressure exerted by the elastic deformation of the housing as a result of the press-fitting of the nut. However, in the nut-prefixed connector according to the present invention, the nut inserted in the nut-holding room of the housing is held therein by the projection, which is provided at the entrance thereof, so the housing of the connector according to the present invention does not need as great a strength as required for the prior-art connector, which must withstand the press-fitting of the nut. Therefore, the housing of the connector according to the present invention can be formed thinner with reduced external dimensions than that of the prior-art connector. Thus, the present invention enables a further miniaturization of the connector. In addition, when this connector is mounted on a circuit board and passed through a furnace during an assembly process, even if the housing experiences a stress relief because of the heating, there is no possibility of the nut falling off from the housing. In a case of the prior-art connector whose nut is press-fit and retained therein by the elastic deformation of the housing, the nut may fall off as the housing experiences a stress relief. Because there is no such problem with the connector according to the present invention, the assembly process can be operated at an improved efficiency. Furthermore, in the connector according to the present invention, the nut inserted is kept therein by a simple structure, not by the pressure that is generated from the deformation of the housing, which is the case with the prior-art connector. As a result, the nut-fixing part of the connector according to the present invention does not require the same level of precision for the dimensions of the nut-holding room as the prior-art connector. Therefore, the cost-effectiveness of the connector can be improved further. In addition, because the design of the nut-holding room does not require a high level of precision, a few types of nuts with a relatively wide range of dimensions (especially for the thickness) can be used in the connector without any design change of the housing.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only and thus are not limitative of the present invention.

FIG. 4A is a view being looked at slantingly from a front side while FIG. 4B is a view being looked at slantingly from a rear side.

DESCRIPTION OF THE PREFERRED EMBODIMENTS

Figure 1:
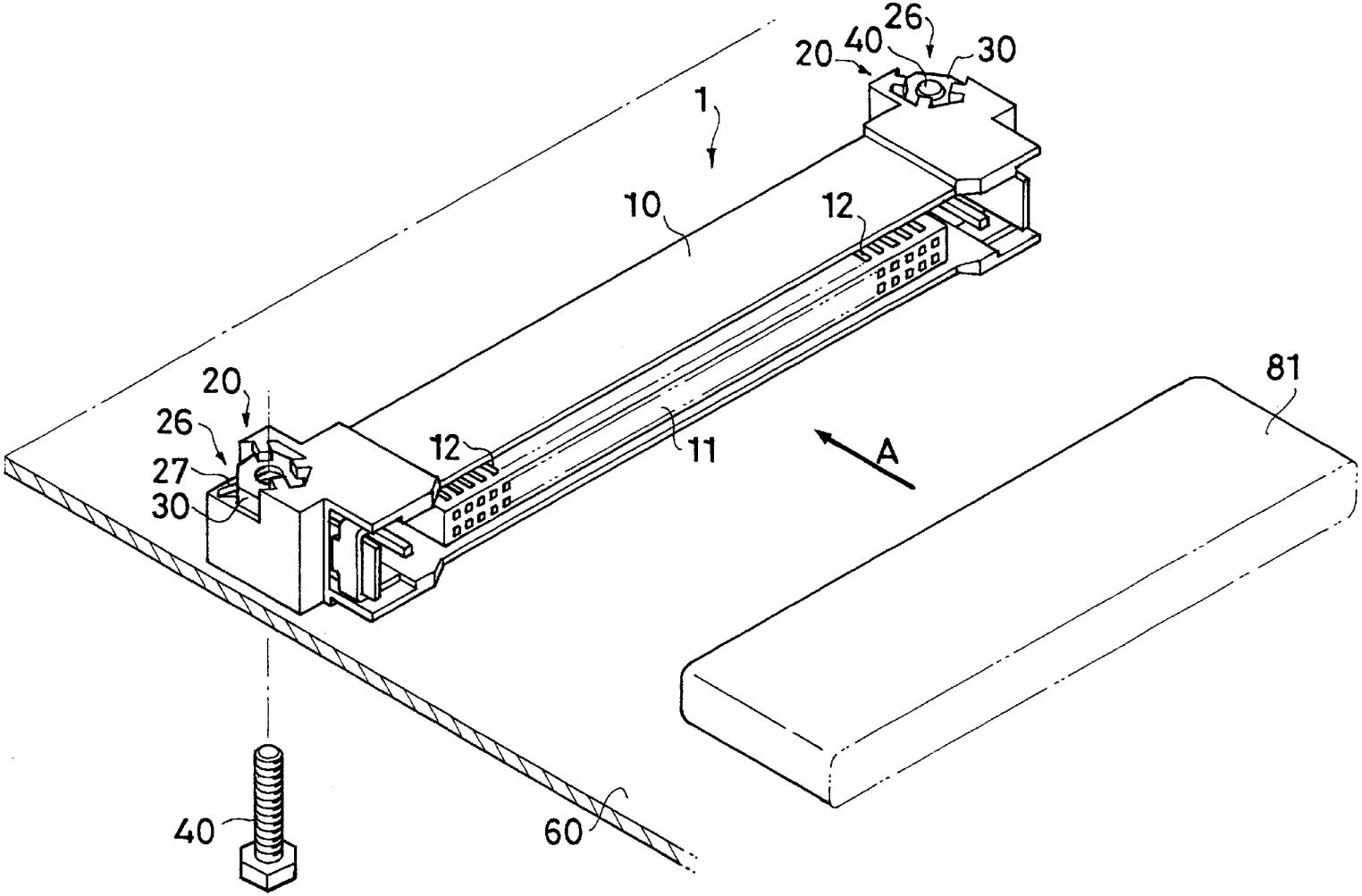
FIG. 1 is a perspective view of a nut-prefixed connector according to the present invention, looked at slantingly from a front side.
Figure 2:
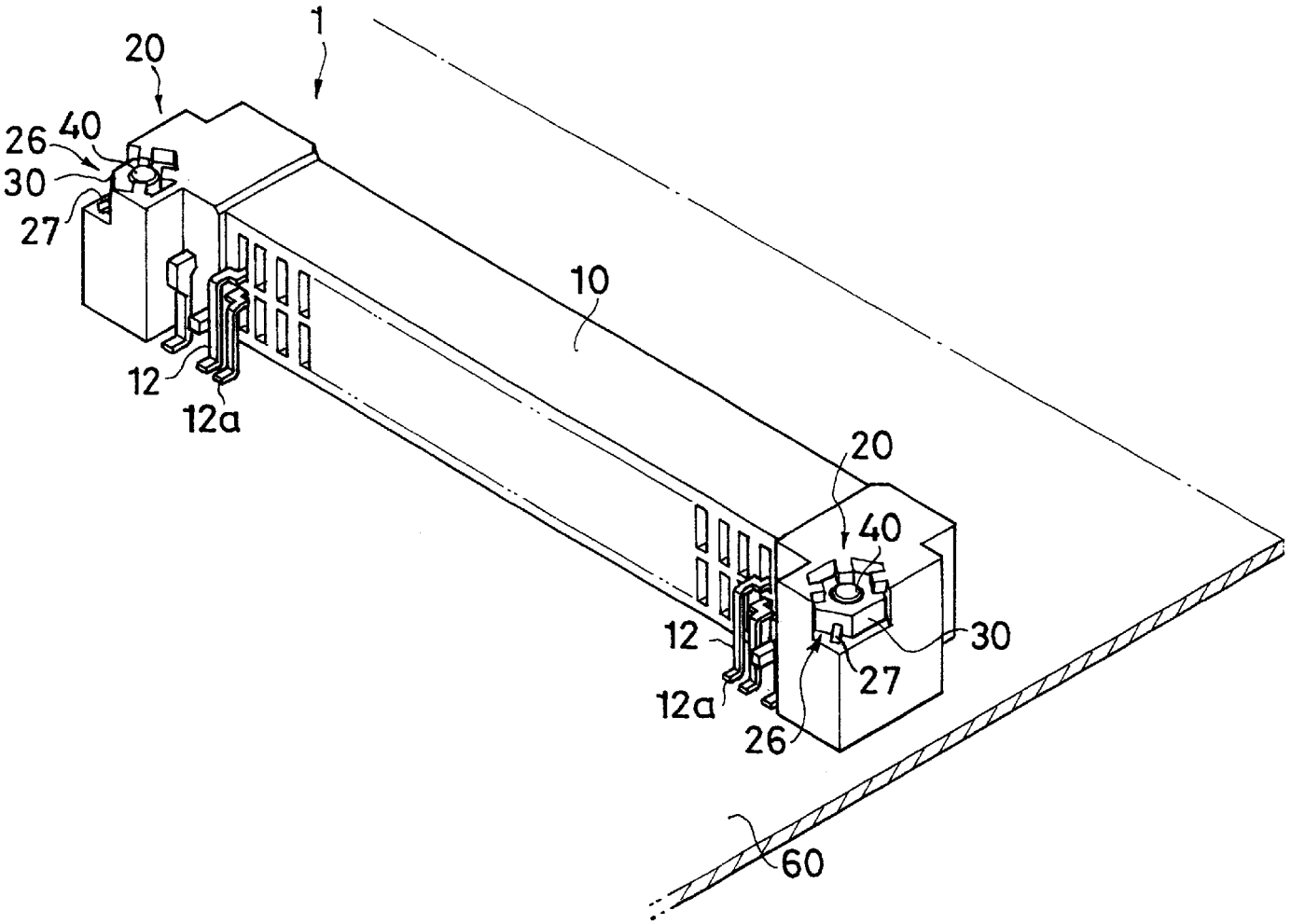
FIG. 2 is a perspective view of the connector, looked at slantingly from a rear side.

FIG. 1 and FIG. 2 show a nut-prefixed connector (hereinafter referred to simply as "connector") 1 according to the present invention with a matable connector 81, which engages with this connector 1. FIG. 1 shows a view of the connector 1 slantingly from a front side while FIG. 2 shows a view of the same connector slantingly from a rear side ( the direction in which the connector 1 faces the matable connector 81 is herein defined as "forward").

As shown in these figures, the connector 1 comprises a housing 10, which has a laterally extending rectangular box figure, and a plurality of contacts 12, which are mounted in the housing 10, each contact extending in the front and rear direction. As shown in FIG. 1, the housing 10 opens forward, and it has a protrusion 11 which protrudes forward in the opening. The contacts 12 are mounted through the protrusion 11 in two rows, each row extending laterally. As shown in FIG. 2, the lead portions 12*a* of the contacts 12 which extend outward from the rear of the connector 1 are surface-mounted and connected onto connection terminals of electrical pathways of a circuit printed on a circuit board 60 (not shown in FIGS. 1 and 2).

The housing 10 is provided with nut-fixing parts 20 at the right and left ends thereof, and nuts ( hexagon nuts ) 30 are attached in the nut-fixing parts 20, respectively. The housing 10 includes through-holes 13 (refer to FIG. 3 ) which extend downward from the nut-fixing parts 20, respectively. The nuts 30 are engageable with bolts 40. At first, the connector is placed and positioned on the circuit board to align the lead portions 12*a* of the contacts 12 with the corresponding connection terminals of the electrical pathways of the circuit on the circuit board 60, and then the bolts 40 are inserted from the lower surface of the circuit board 60 upward through the circuit board 60 and the through-holes 13 of the connector. By fixing the bolts 40 to the nuts 30, the connector 1 is fixed firmly on the circuit board 60.

With the connector 1, which is fixed on the circuit board 60, a matable connector 81 is engaged by moving the matable connector 81 relatively in the direction shown by arrow A in FIG. 1. The housing of the matable connector 81 has an opening (not shown), where a concave part is provided to receive the protrusion 11 of the connector 1. In this concave part of the matable connector 81, a plurality of contacts are provided and arranged to meet and engage with the corresponding contacts 12 in the protrusion 11 of the connector 1. As a result, when the connector 1 is engaged with the matable connector 81, a signal transmission is possible through the connector assembly.

Figure 3:
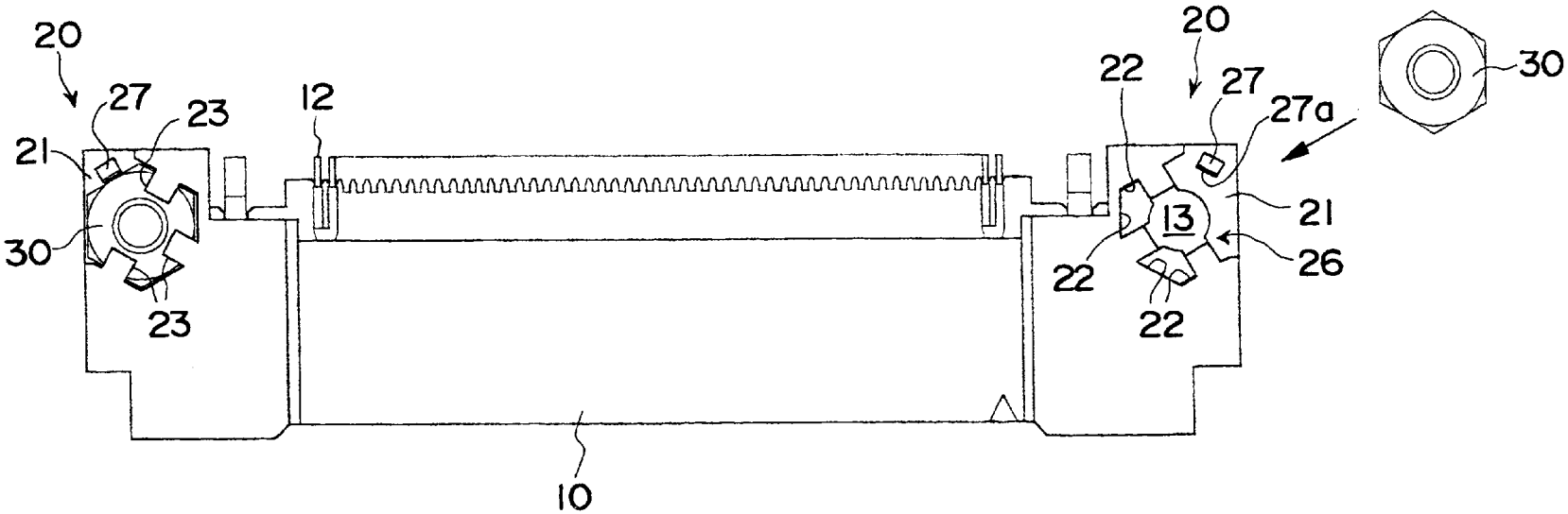
FIG. 3 is a plan view of the connector.

FIG. 3 is a plan view of the connector 1 (the lower side of the figure is the front of the connector 1. Bolts 40 are not shown). The nut-fixing parts 20, which are to hold the nuts 30, are provided at the right and left ends of the housing 10 as shown in this figure. Each nut-fixing part 20 in the body of the housing 10 includes a lower wall 21 which is formed lower than the upper surface of the housing 10, four lateral walls 22 which are to meet four lateral surfaces of the six lateral faces of the nut 30, and three nut-holding arms (upper wall) 23 which extend horizontally inward from the lateral walls 22. The lower wall 21, the lateral walls 22, and the nut-holding arms 23 together define a nut-holding room 26, where a nut 30 is insertable by a shift in a direction perpendicular to the thickness direction of the nut 30. The nut-holding room 26 has a storing space just enough to accommodate the nut, so the inserted nut 30 cannot wobble. Furthermore, a projection 27 is formed with the housing 10 at the entrance of the nut-holding room 26 to prevent the nut 30 inserted in the nut-holding room 26 from escaping.

For installing the nuts 30 in the nut-fixing parts 20, the nuts 30 are inserted through the entrance of the nut-holding room 26. As shown in FIG. 3, the entrance of the nut-holding room 26 are provided in the diagonal directions of the housing 10, so the right and left nuts 30 are inserted in the diagonal cross directions of the housing 10. Four lateral surfaces of each nut 30 installed in a corresponding nut-holding room 26 are in contact with the four lateral walls 22 of the nut-fixing part 20 of the housing 10 while one of the remaining lateral surfaces of the nut 30 is in contact with the inner face 27*a* of the projection 27. In this condition, the nuts 30 are fixed firmly in the nut-fixing parts 20, respectively. As shown in FIG. 1 and FIG. 2, preferably, each projection 27 is formed with a gentle slope (tapered like a triangular column as shown in the figure) in the direction of the insertion of the nut 30. With this arrangement, the nuts 30 are inserted relatively easily, but they will not come out so easily from the nut-holding rooms 26. If the housing 10 is made of a resin, then the insertion of the nuts 30 will be easier because the whole nut-fixing parts 20 can undergo an elastic deformation.

In this connector 1, the nuts 30 inserted in the nut-holding rooms 26 of the housing 10 are held therein by the projections 27 provided at the entrances thereof. As the nuts 30 are not installed and fixed by a method of press-fitting, the housing 10 does not need to be formed with a thickness which is required to withstand the impact of the press-fitting in a conventional connector. Therefore, the external dimensions of this connector can be reduced to miniaturize the connector 1. Furthermore, when this connector 1 is surface-mounted on the circuit board 60 by placing the lead portions 12*a* of the contacts 12 of the connector 1 on the connection terminals of the electrical pathways of the circuit printed on the circuit board and then by passing the connector and the circuit board together through a furnace to heat and fuse the solder provided between the lead portions 12*a* of the contacts 12 and the corresponding terminals of the circuit, there is no possibility of any of the nuts 30 to fall off from the housing. As mentioned previously, in the case of a prior-art connector whose nuts are press-fit therein, the housing may lose one or two of the nuts during this heating process because the housing holding the nuts loosens to release the stress that is created from the press-fitting of the nuts. In comparison, the connector 1 according to the present invention is advantageous on this point because of the above described construction of the connector 1, so the assembly process can be carried out more efficiently.

Furthermore, the entrances of the nut-holding rooms 26 of the connector 1 are arranged diagonally, so the projections 27 can be provided easily on the lateral lower walls 21 at corners of the housing 10 without sparing special spaces for the positioning of the projections 27. In other words, if the entrances of the nut-holding rooms 26 were arranged in the front and rear direction or in the right and left direction, the housing 10 would need extra spaces in the front and rear direction or in the right and left direction for the provision of the projections 27. However, the connector 1 constructed as described above is compact without any such extra space. Moreover, the nuts of the connector 1 are kept therein not by the pressure generated by the deformation of the housing, which is the case when the nuts are press-fit in a prior-art connector, but they are maintained there by a simple structure which is designed to hold the nuts. This structural feature does not require the same degree of precision for the dimensions of the nut-holding rooms 26 as the prior-art connector. Therefore, the production cost of the connector 1 can be comparatively low. In addition, because the design of the nut-holding rooms 26 does not require a high degree of precision, a few types of nuts with a relatively wide range of dimensions (especially with various dimensions for the thickness) can be used in the connector 1 without any design change of the housing 10.

In the connector 1, each of the upper walls of the nut-holding rooms 26 is constituted of a plurality of nut-holding arms 23, which project inward from the upper end of the nut-holding room 26 to hold the respective nut 30, so the nut-holding rooms 26 are not totally closed but are somewhat open upward. This construction is advantageous for fabricating metal molds to mass-produce the housing 10, so the connector 1 can be manufactured cost-effectively.

Figure 4A:
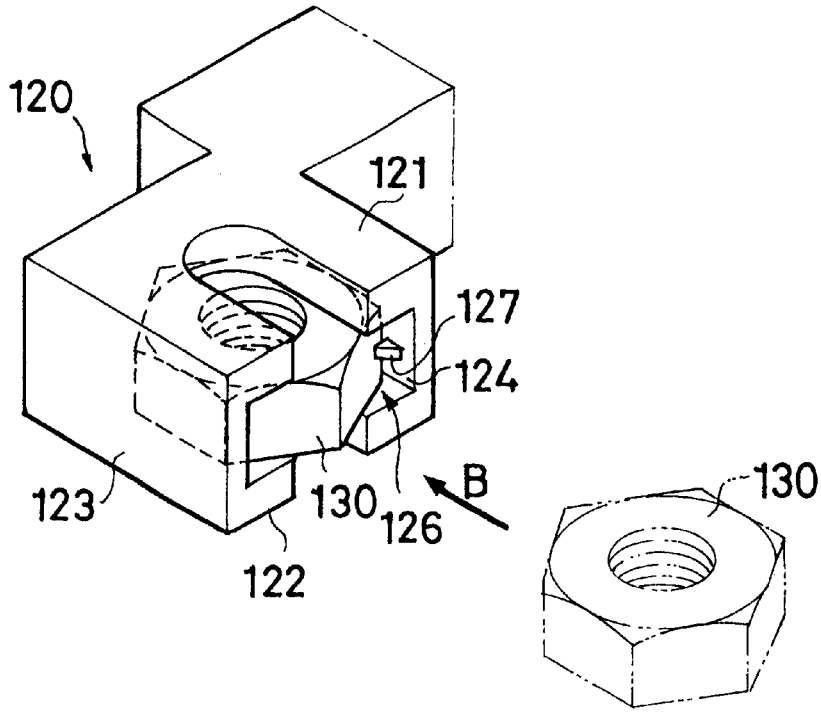
FIGS. 4A and 4B are perspective views of a nut-fixing part of another nut-prefixed connector according to the present invention.
Figure 4B:
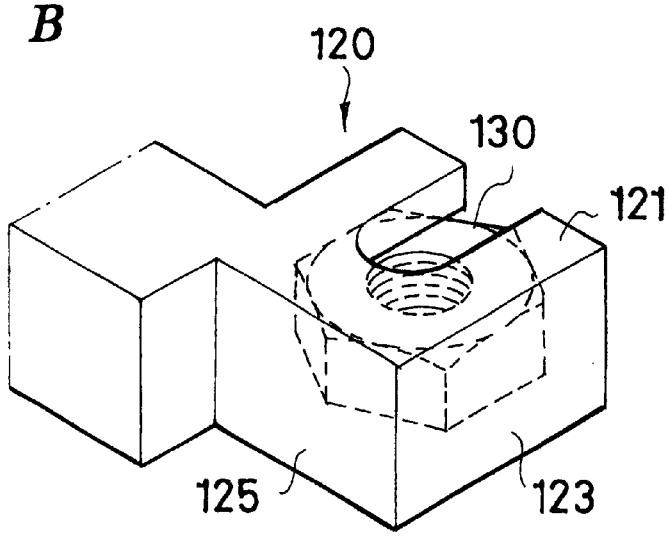

Another embodiment of nut-prefixed connector according to the present invention is shown in FIG. 4A and FIG. 4B. The design of this connector is based on a conventional connector whose nuts are press-fit in the housing, but the housing of this connector includes projections, each of which is provided at the entrance of a corresponding nut-holding room ( where a nut is press-fit) to prevent the respective nuts from coming out. The side of the housing which has openings for receiving nuts 130 is defined here as the front of the connector. In this housing, each of the openings leads to a nut-fixing part 120, respectively, and each nut-fixing part 120 comprises an upper wall 121, a lower wall 122, right and left lateral walls 123 and 124 and a rear wall 125. These walls together define a nut-holding room 126 which can receive a nut 130 inserted by a relative movement in a direction perpendicular to the thickness of the nut. The centers of the upper wall 121 and the lower wall 122 are U-shaped, opening forward to make the press-fitting of the nuts 130 easier, and a projection 127 is provided at the entrance of the nut-holding room 126 on the right lateral wall 124 of the housing to prevent the nut 130 from escaping.

For the installation of the nut 130 in the nut-fixing part 120, the nut 130 is inserted through the entrance of the nut-holding room from the front of the connector. Upon insertion, the nut 130 received in the nut-holding room 126 is held and fixed by the projection 127 in the nut-fixing part 120 in the same way as in the case of the above-mentioned embodiment. It means that if the housing of a prior-art connector having press-fit nuts is provided with a projection at the entrance of the nut-holding room, the nuts are prevented from escaping. In this way, the same effect is achieved as the previously mentioned embodiment. In the embodiment shown in FIG. 4, the projection 127 is provided on the lateral wall 124 of the nut-fixing part 120. However, the projection 127 may be provided on the upper wall 121 or on the lower wall 122, instead.

The present invention is not limited to the above described embodiments of nut-prefixed connector. For example, other embodiments are also possible as long as the nut-holding room is formed to receive a nut which is inserted therein by a relative movement in a direction perpendicular to the thickness direction of the nut. Also, the upper or lower wall does not need to be open as in the above described embodiments. However, if the connector is designed to have an opening in the upper or lower wall, then the molding of the housing can be simpler, and also the rigidity of the nut-fixing part becomes smaller, making the insertion of the nut into the nut-holding room easier.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A nut-prefixed connector comprising:

a housing;

a plurality of contacts, which are retained in said housing; and a nut, which is mounted in a nut-fixing part provided in said housing, with said contacts of said connector being placed on a circuit board, said nut being engageable with a bolt extending and inserted from a side of said circuit board to fix said housing on said circuit board;

wherein:

said nut-fixing part has a nut-holding room into which and from which said nut is insertable and detachable by a movement in a direction perpendicular to a thickness direction of said nut; and a projection is provided at an entrance to said nut-holding room to prevent said nut inserted in said nut-holding room from coming out.

2. The nut-prefixed connector set forth in claim 1, wherein:

said nut is a hexagon nut;

said nut-fixing part comprises a lower wall which is lower than an upper surface of said housing, four lateral walls which are to meet four of six lateral surfaces of said nut, and three nut-holding arms which extend horizontally inward from said lateral walls; and said lower wall, said lateral walls, and said nut-holding arms together define said nut-holding room.

3. The nut-prefixed connector set forth in claim 2, wherein:

said nut-holding room has a space large enough to accommodate said nut inserted therein but small enough to prevent said nut from wobbling; and said projection, which prevents said nut inserted in said nut-holding room from coming out, is provided at said entrance of said nut-holding room.

4. The nut-prefixed connector set forth in claim 2, wherein:

said entrance of said nut-holding room is open outwardly in a slanting direction against a front of said housing; and said nut is inserted slantingly through said entrance into said nut-holding room.

5. The nut-prefixed connector set forth in claim 3, wherein said projection, which prevents said nut from coming out, is formed in a triangular block which tapers oppositely in a direction where said nut is inserted into said nut-holding room.

6. The nut-prefixed connector set forth in claim 1, wherein said nut-fixing part comprises an upper wall, a lower wall, right and left lateral walls and a rear wall, such that said nut is insertable into said nut-fixing part by a movement in a direction perpendicular to said thickness direction of said nut.

7. The nut-prefixed connector set forth in claim 6, wherein central portions of said upper and lower walls are cut away in a U-shaped figure, respectively, opening forward, such that said nut can be press-fit into said nut-fixing part relatively easily.

8. The nut-prefixed connector set forth in claim 6, wherein said projection to prevent said nut from coming out is provided on an inside surface of said right lateral wall at said entrance of said nut-holding room.

9. The nut-prefixed connector set forth in claim 6, wherein said projection to prevent said nut from coming out is provided on said upper or lower wall at said entrance of said nut-holding room.

10. A printed circuit board connector comprising a housing formed of plastic material retaining a plurality of contacts for connection to a printed circuit board, the housing being formed with a rotation preventing, nut receiving cavity with a clamping bolt receiving opening and a nut admitting entrance having detent catch means for retaining the nut in the cavity with a face of the nut aligned centrally with the clamping bolt receiving opening, the detent catch means being over-ridable with a detent action to admit the nut into the cavity by forcible insertion of the nut, edge first, in a direction perpendicular to a thickness direction of said nut, through the entrance.

* * * * *